United States Patent [19]

Kean

[11] 3,987,503

[45] Oct. 26, 1976

[54] MATTRESS SUPPORT

[75] Inventor: Jacob J. Kean, Spring Valley, N.Y.

[73] Assignee: The Raymond Lee Organization, Inc., a part interest.

[22] Filed: Aug. 11, 1975

[21] Appl. No.: 603,441

[52] U.S. Cl. ..... 5/63; 5/11

[51] Int. Cl.[2] ..... A47C 17/14; A61G 7/10

[58] Field of Search ..... 5/60–63, 5/91, 317 R, 327 R, 345; 312/26–29, 306, 310

[56] References Cited

UNITED STATES PATENTS

| | | | |
|---|---|---|---|
| 2,812,226 | 11/1957 | Wolters | 312/310 |
| 2,984,844 | 5/1961 | Reddin | 5/345 R |
| 3,138,806 | 6/1964 | Goodman et al. | 5/345 R |
| 3,887,950 | 6/1975 | Wachsman | 5/63 |

*Primary Examiner*—Casmir A. Nunberg

[57] ABSTRACT

A plurality of like, parallel, transversely extending assemblies connects an upper frame and a lower frame together. The frames are alike, each being generally rectangular and having an open center, and are disposed in parallel horizontal planes with the upper frame above the lower frame. The assemblies allow the upper frame to be moved downwardly towards the lower frame while being always maintained in a horizontal plane.

Each assembly includes two opposed roller means that are pushed to roll inwardly towards each other whenever the upper frame is pushed downwardly. A tension spring biases each roller means outwardly, to maintain the upper frame in its original position when no weight rests upon it.

The entire device can rest upon a suitable support.

The upper frame accommodates a removable padded upholstered board constructed to resemble the top of a box spring.

3 Claims, 4 Drawing Figures

MATTRESS SUPPORT

SUMMARY OF THE INVENTION

The object of the invention is to provide a mattress support that will adjust to the weight of the users of the mattress.

Thus, a generally rectangular lower frame with an open center is placed upon a horizontal surface or any box spring support. A like upper frame that supports a mattress is suspended above the lower frame, and can be moved downwardly towards the lower frame under the influence of the weight of the users. Means connecting the two frames maintains the upper frame in a horizontal position regardless of its height from the lower frame, and biases the upper frame upwardly to allow it to return to its original position when no weight is placed upon it.

The upper frame can accommodate a removable support board padded and upholstered as described in more detail below.

The entire product can rest upon a suitable support frame.

DETAILED DESCRIPTION OF THE DRAWINGS

DETAILED DESCRIPTION OF PREFERRED EMBODIMENTS

A generally rectangular upper frame 10 with an open center is disposed parallel to and above a like lower frame 20.

Figure 1:
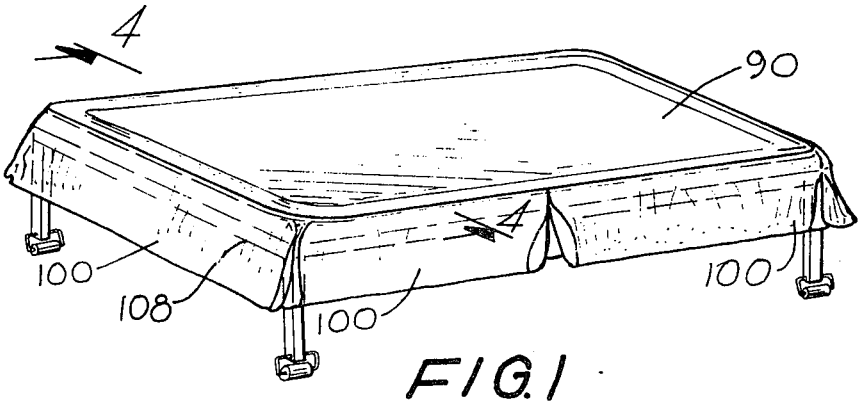
FIG. 1 shows the invention ready for use.
Figure 2:
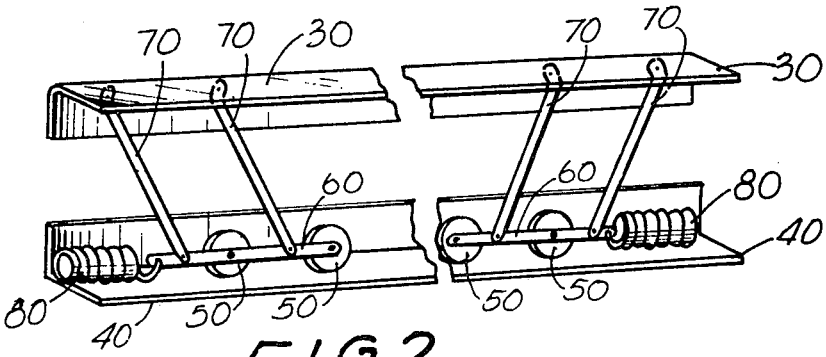
FIG. 2 is a detail of a portion of the invention.
Figure 4:
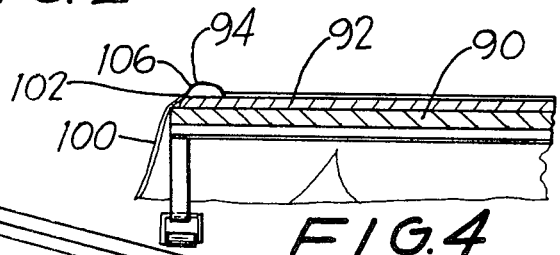
FIG. 4 is a detail cross section of a portion of the invention.
Figure 3:
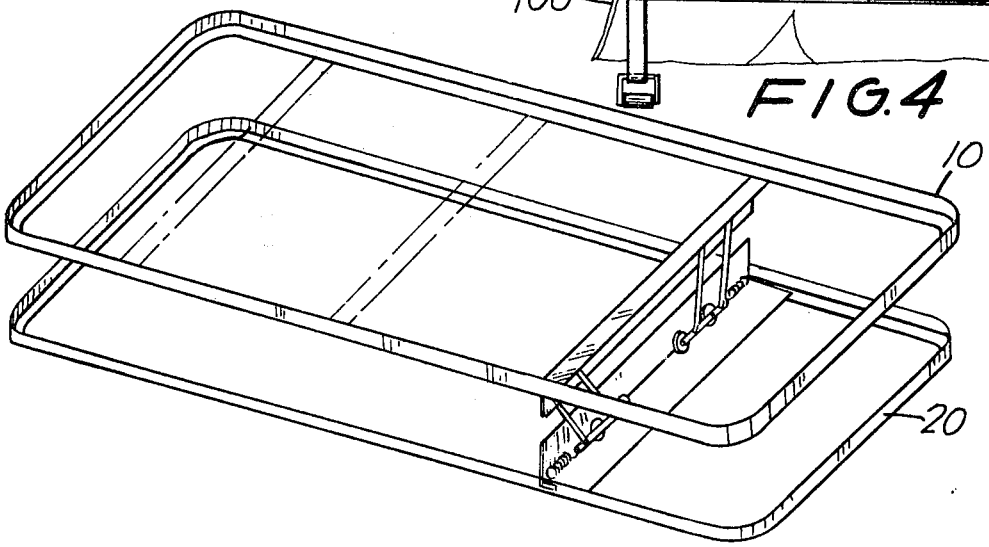
FIG. 3 shows the relationship of the contents of FIG. 2 to the rest of the invention.

Connecting the two frames are a plurality of parallel, transversely extending assemblies such as are shown in FIG. 2. Each includes an L-shaped elongated member 30 extending between the sides of frame 20. Both the member and the track have parallel horizontal flanges and coplanar vertical flanges.

Each assembly further includes two like opposed roller means, which has two wheels 50 rotatably mounted upon an elongated bar 60 so as to roll back and forth upon the horizontal flange of the track. Each bar is pivotally secured to two, like, parallel arms 70 which are also pivotally secured to the vertical flange of the track. A deformable parallelogram is thus formed, with the bars 60 being moved inwardly towards each other when the upper frame is depressed. The parallelogram structure of the arms and bars insures that the frames will always remain parallel. A tension spring 80 connected between the outward end of each bar and the track biases the bars outwardly so as to cause the upper frame to rise to its highest position when weights have been removed from it, or from the mattress it supports.

In use, the upper frame accommodates a flat, rectangular support board 90. The board 90 is padded at 92 and upholstered at 94 and then covered with ticking 106. The outer skirt or drape 100 is affixed to the ticking and then, by means of a cloth piece 102 joined to the upper inside part of the skirt, it is fastened under the board to keep it in place.

The bottom of the board is then covered with a black cambric. Thus the appearance of the top of present day type box spring is created. The board is also removable for cleaning and easier handling.

The entire product can rest on a Harvard type metal frame 108 or the like.

Although the invention has been described with particular reference to the drawings, the protection sought is to be limited only by the terms of the claims which follow.

What is claimed is:

1. A mattress support, comprising:

a generally rectangular horizontal lower frame having an open center;

a like upper frame located above the lower frame and parallel to it;

a plurality of elongated straight members extending transversely between the sides of the upper frame;

a like plurality of flat horizontal tracks, each located below a corresponding member and extending transversely between the sides of the lower member;

a like plurality of opposed pairs of spring loaded roller means, each pair rolling inwardly towards each other on top of a corresponding track and being biased away from each other; and parallel arms connecting each roller means with the member in a manner that the roller means roll inwardly towards each other when the member is pressed downwardly towards the track by a weight.

2. The support of claim 1 further including a flat rectangular support board covering the upper frame.

3. The support of claim 2 wherein the board is padded, upholstered and is removable.

* * * * *